US008040060B2

(12) United States Patent
Fukasawa et al.

(10) Patent No.: US 8,040,060 B2
(45) Date of Patent: Oct. 18, 2011

(54) ELECTRON TUBE

(75) Inventors: Atsuhito Fukasawa, Hamamatsu (JP); Yasuyuki Egawa, Hamamatsu (JP); Motohiro Suyama, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 386 days.

(21) Appl. No.: 12/257,151

(22) Filed: Oct. 23, 2008

(65) Prior Publication Data

US 2010/0102721 A1 Apr. 29, 2010

(51) Int. Cl.
*H01J 40/06* (2006.01)

(52) U.S. Cl. ..... 313/544; 313/103 R

(58) Field of Classification Search ..... 313/541–544, 313/532, 538
See application file for complete search history.

(56) References Cited

U.S. PATENT DOCUMENTS

| | | | | |
|---|---|---|---|---|
| 4,030,789 | A * | 6/1977 | Schampers et al. | 445/42 |
| 4,717,860 | A * | 1/1988 | Christgau et al. | 313/525 |
| 4,961,026 | A | 10/1990 | Funk et al. | |
| 5,374,826 | A | 12/1994 | LaRue et al. | |
| 5,498,926 | A | 3/1996 | Kyushima et al. | |
| 5,594,301 | A | 1/1997 | Sawai et al. | |
| 6,020,684 | A | 2/2000 | Negi et al. | |
| 2007/0029930 | A1 | 2/2007 | Suyama et al. | |

FOREIGN PATENT DOCUMENTS

| | | |
|---|---|---|
| JP | 4-292843 | 10/1992 |
| JP | 7-51729 | 11/1995 |
| JP | 7-320681 | 12/1995 |
| JP | 10-241623 | 9/1998 |
| JP | 10-332478 | 12/1998 |
| JP | 2000-149791 | 5/2000 |
| JP | 2004-241298 | 8/2004 |
| WO | WO 2006/046619 | 5/2006 |
| WO | WO 2007/111072 | 10/2007 |

OTHER PUBLICATIONS

R. Kalibjian, "A Phototube Using a Semiconductor Diode as the Multiplier Element," IEEE Transactions on Nuclear Science, Jun. 1966, pp. 54-62.
K. Arisaka et al., "XAX: a multi-ton, multi-target detection system for dark matter, double beta decay and pp solar neutrinos," pp. 1-16.
K. Arisaka, "XAX 10 ton Noble-Liquid Double-Phase TPC for Rare Processes," MS Power Point presentation at DUSEL Town Meeting, Washington, D.C., Nov. 3, 2007, pp. 1-19 (with two (2) page Town Meeting announcement).

* cited by examiner

*Primary Examiner* — Bumsuk Won
*Assistant Examiner* — Brenitra Lee
(74) *Attorney, Agent, or Firm* — Drinker Biddle & Reath LLP

(57) ABSTRACT

An electron tube of the present invention includes: a vacuum vessel including a side tube portion made of glass and a plate-like member blocking one opening of the side tube portion and made of glass; a first metal film provided on an end face of the side tube portion; a second metal film arranged facing the first metal film and provided on a marginal part of a face at a vacuum side of the plate-like member; a third metal film provided on at least one of an outer wall face of the side tube portion adjacent to the end face and a side face of the plate-like member adjacent to the marginal part; and a metal member made of a low-melting-point metal, for sealing a gap between the side tube portion and the plate-like member while contacting the first metal film, the second metal film, and the third metal film.

6 Claims, 12 Drawing Sheets

ELECTRON TUBE

BACKGROUND OF THE INVENTION

1. Field of the Invention

The present invention relates to an electron tube.

2. Related Background Art

U.S. Pat. No. 6,020,684 discloses an electron tube sealed with indium between its face plate and side tube.

SUMMARY OF THE INVENTION

An electron tube of the present invention includes: a vacuum vessel including a side tube portion made of glass and a plate-like member blocking one opening of the side tube portion and made of glass; a first metal film provided on an end face of the side tube portion; a second metal film arranged facing the first metal film and provided on a marginal part of a face at a vacuum side of the plate-like member; a third metal film provided on at least one of an outer wall face of the side tube portion adjacent to the end face and a side face of the plate-like member adjacent to the marginal part; and a metal member made of a low-melting-point metal, for sealing a gap between the side tube portion and the plate-like member while contacting the first metal film, the second metal film, and the third metal film.

DESCRIPTION OF THE PREFERRED EMBODIMENTS

Figure 1:
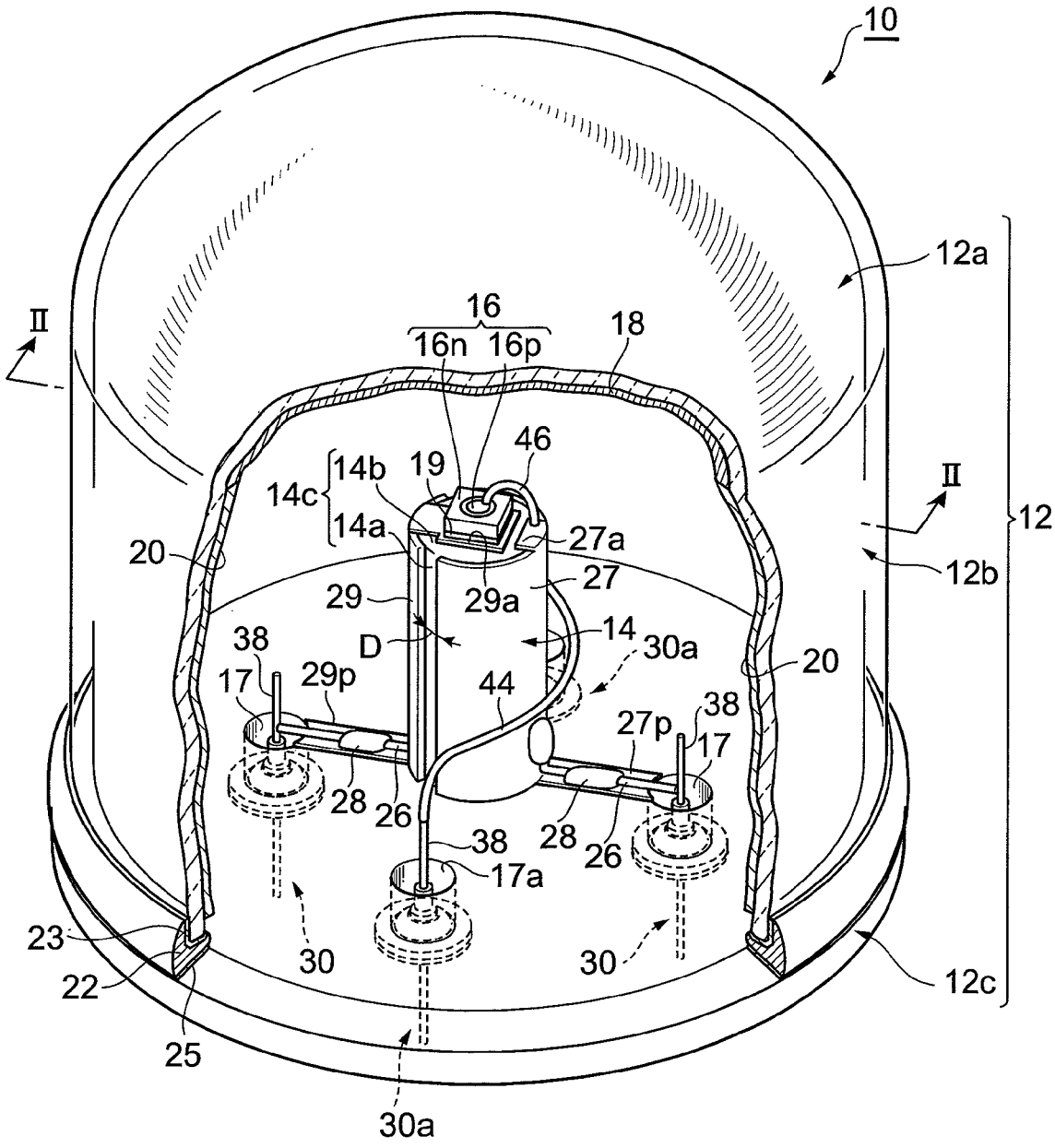
FIG. 1 is a perspective view, partially broken away, schematically showing an electron tube according to a first embodiment.

Hereinafter, a preferred embodiment of the present invention will be described in detail with reference to the accompanying drawings. For easy understanding of the description, components that are identical in the respective drawings are denoted whenever possible by identical reference numerals and overlapping description will be omitted.

First Embodiment

Figure 2:
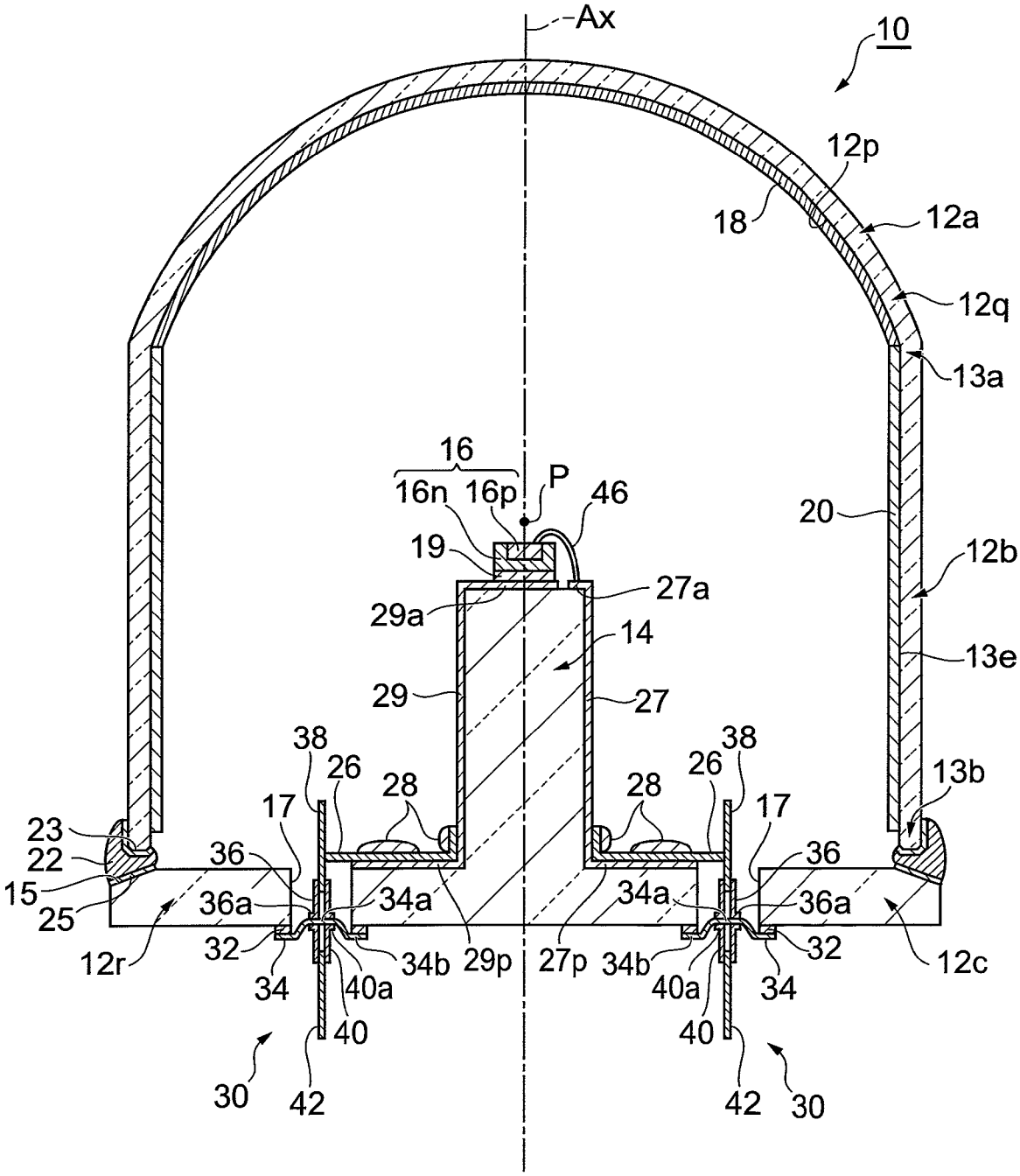
FIG. 2 is a sectional view along a line II-II shown in FIG. 1.
Figure 3:
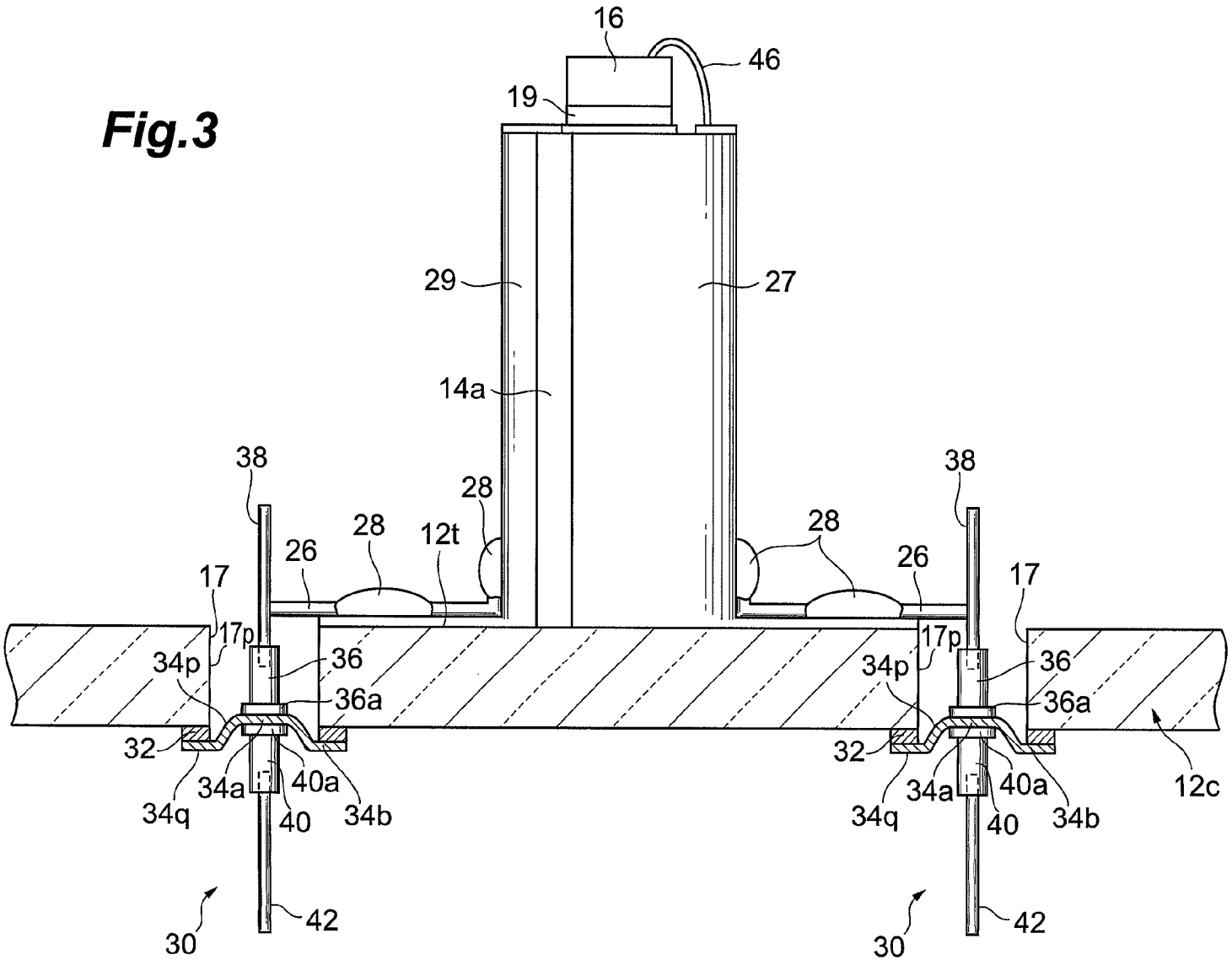
FIG. 3 is a partially enlarged view of a section along a line II-II shown in FIG. 1.
Figure 4:
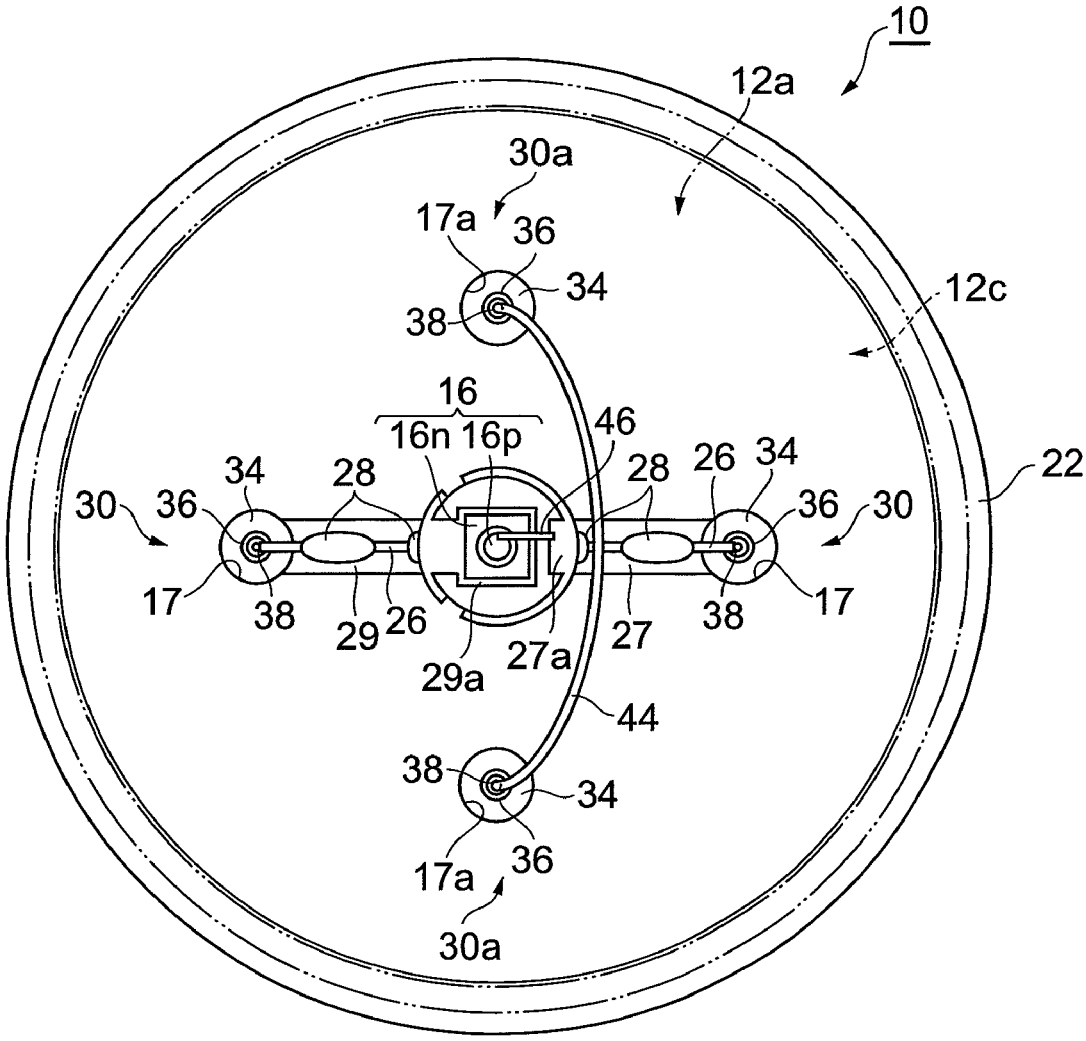
FIG. 4 is a plan view of an electron tube according to the first embodiment.
Figure 5:
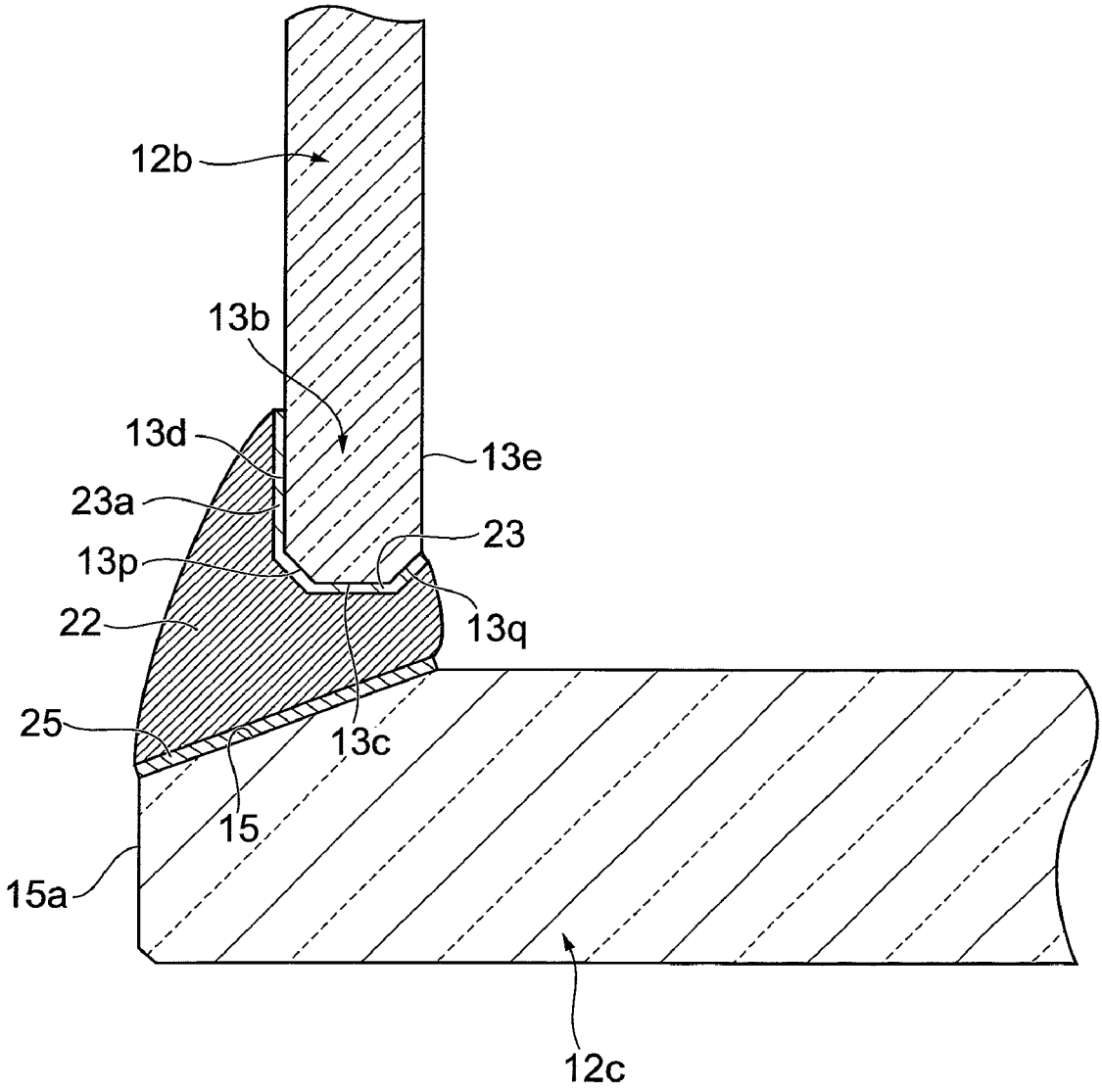
FIG. 5 is a partially enlarged view of FIG. 2.

FIG. 1 is a perspective view, partially broken away, schematically showing an electron tube according to a first embodiment. FIG. 2 is a sectional view along a line II-II shown in FIG. 1. FIG. 3 is a partially enlarged view of a section along a line II-II shown in FIG. 1. FIG. 4 is a plan view of an electron tube according to the first embodiment. FIG. 5 is a partially enlarged view of FIG. 2. As shown in FIG. 1 to FIG. 5, an electron tube 10 includes a vacuum vessel 12 that maintains a vacuum inside, a projection portion 14 arranged in the vacuum vessel 12, an electron detector 16 serving as an electron detecting section arranged on the projection portion 14, and a first conductive film 27 and a second conductive film 29 electrically connected to the electron detector 16.

The vacuum vessel 12 can include a face plate portion 12*a* provided on one surface 12*p* thereof with a photocathode 18, a side tube portion (valve) 12*b*, a stem portion (base) 12*c* arranged facing the photocathode 18. The face plate portion 12*a* blocks one opening of the side tube portion 12*b*. The stem portion 12*c* blocks the other opening of the side tube portion 12*b*. The face plate portion 12*a*, the side tube portion 12*b*, and the stem portion 12*c* are preferably made of synthetic silica. In this case, since the content of radioactive impurities contained in the synthetic silica is small, the quantity of radiation to be generated from the face plate portion 12*a*, the side tube portion 12*b*, and the stem portion 12*c* is reduced, and generation of noise at the time of radiation detection can be suppressed.

The face plate portion 12*a* is a plate-like member such as, for example, a dome, a hemispherical shell, a flat plate, or the like. A section in the thickness direction of the face plate portion 12*a* preferably extends along an arc having a center at a predetermined position P, on a tube axis Ax of the electron tube 10, between the electron detector 16 and the photocathode 18. In this case, the distance between the photocathode 18 and the electron detector 16 becomes almost fixed across the entire photocathode 18. The photocathode 18 is arranged at the vacuum side of the face plate portion 12*a*, and can convert light that has reached the photocathode 18 through the face plate portion 12*a* from the outside to photoelectrons and emit the photoelectrons toward the electron detector 16. The photocathode 18 can function as a photocathode. The voltage of the photocathode 18 is, for example, −8 kV. The photocathode 18 is a bialkali photocathode of, for example, K2CsSb.

The side tube portion 12*b* has, for example, one end 13*a* connected to a peripheral part 12*q* of the face plate portion 12*a* and the other end 13*b* connected to a peripheral part 12*r* of the stem portion 12*c*. The side tube portion 12*b* is, for example, a circular cylinder. On an inner wall face 13*e* of the side tube portion 12*b*, a metal film 20 electrically connected with the photocathode 18 is preferably evaporated. This allows forming an electric field favorable for electron focusing in the electron tube 10. The metal film 20 is made of, for example, aluminum. If focusing of the photoelectrons is sufficient, the metal film 20 may not be formed.

The stem portion 12*c* is a plate-like member such as, for example, a disk or the like. The stem portion 12*c* is preferably formed with a plurality of openings 17. To each of the plurality of openings 17, a sealing body 30 can be attached. An opening surface of the opening 17 is, for example, circular.

The sealing body 30 preferably has a lid portion 34 connected to a stem portion 12*c* via a joining member 32 made of aluminum, so as to seal the opening 17. Sealing of the opening 17 is preferably realized by being pressurized under a temperature of, for example, 400° C. to 600° C. The joining member 32 is, for example, a ring made of aluminum. The lid portion 34 preferably has a recess portion 34*a* depressed to the vacuum side in the opening 17 and is preferably made of Kovar. Since the surface area of a part corresponding to the opening 17 in the lid portion 34 is preferably larger than a cross-sectional area of the opening 17, the recess portion 34*a* may be depressed to the side (atmosphere side) opposite to the vacuum side. The recess portion 34*a* is formed at, for example, a central portion of the lid portion 34. The bottom surface of the recess portion 34*a* is preferably flat. The shape of the lid portion 34 is, for example, a dish shape.

The lid portion 34 has, for example, a marginal portion 34*b* surrounding the recess portion 34*a*. The marginal portion 34*b* is preferably connected to the stem portion 12*c* via the joining member 32. The lid portion 34 is preferably arranged outside the vacuum vessel 12 and separated from an inner surface 17*p* of the opening 17.

The sealing body 30 preferably includes a conductive first tubular member 36 electrically connected to a face 34*p* at the vacuum side of the lid portion 34 and a first electrode pin 38 to be inserted in and electrically connected to the first tubular member 36. The first electrode pin 38 is preferably separated from the bottom surface of the recess portion 34*a*. The first tubular member 36 is, for example, a nickel eyelet. The first electrode pin 38 is made of a metal such as, for example, nickel or Kovar. The first tubular member 36 preferably has a flange portion 36*a* to be electrically connected to the lid portion 34 at one end of the first tubular member 36. The flange portion 36*a* of the first tubular member 36 is connected to the bottom surface of the recess portion 34*a* by, for example, welding. The first electrode pin 38 is connected to the first tubular member 36 by, for example, welding. The sealing body 30 may not include the first tubular member 36 and the first electrode pin 38 if a power feeding member is separately provided.

The sealing body 30 preferably includes a conductive second tubular member 40 electrically connected to a face 34*q* which is at the side opposite to the face 34*p* at the vacuum side of the lid portion 34 and a second electrode pin 42 to be inserted in and electrically connected to the second tubular member 40. The second electrode pin 42 is preferably separated from the bottom surface of the recess portion 34*a*. The second tubular member 40 is, for example, a nickel eyelet. The second electrode pin 42 is made of a metal such as, for example, nickel or Kovar. The second tubular member 40 preferably has a flange portion 40*a* to be electrically connected to the lid portion 34 at one end of the first tubular member 40. The flange portion 40*a* of the second tubular member 40 is connected to the bottom surface of the recess portion 34*a* by, for example, welding. The second electrode pin 42 is connected to the second tubular member 40 by, for example, welding. The sealing body 30 may not include the second tubular member 40 and the second electrode pin 42 if a power feeding member is separately provided.

Moreover, the stem portion 12*c* is preferably formed with a plurality of openings 17*a*. Each of the plurality of openings 17*a* is preferably sealed by a sealing body 30*a*. The sealing body 30*a* has the same construction as that of, for example, the sealing body 30. The plurality of sealing bodies 30*a* are connected, in the vacuum vessel 12, by a getter 44 fixed to a power feeder attached to the electrode pins 38. The sealing bodies 30 and 30*a* are, for example, alternately arranged on a circumference surrounding the projection portion 14.

The projection portion 14 extends from a central part of the stem portion 12*c* toward the photocathode 18 almost vertical to the stem portion 12*c*, and can arrange the electron detector 16 at a desirable position in the electron tube 10. Moreover, the projection portion 14 is made of an insulating material, and preferably made of synthetic silica. Since the content of radioactive impurities contained in the synthetic silica is small, the quantity of radiation to be generated from the projection portion 14 is reduced, and generation of noise at the time of radiation detection can be suppressed. The projection portion 14 may be either integrated with the stem portion 12*c* or provided separately therefrom. The projection portion 14 has, for example, a columnar shape that is almost coaxial with the side tube portion 12*b*.

The electron detector 16 is made of a semiconductor such as silicon, and has a p-type region 16*p* (first conductivity-type region) and an n-type region 16*n* (second conductivity-type region). When the electron detector 16 is made of silicon, since the content of radioactive impurities contained in the silicon is small, the quantity of radiation to be generated from the electron detector 16 is reduced, and generation of noise at the time of radiation detection can be suppressed. The p-type region 16*p* is made of, for example, a semiconductor doped with p-type impurities, and the n-type region 16*n* is made of, for example, a semiconductor doped with n-type impurities. The p-type region 16*p* preferably has an electron incident surface that detects photoelectrons emitted from the photocathode 18. The electron detector 16 has, for example, a square flat plate shape. The electron detector 16 is, for example, an avalanche photodiode, but may be another photodiode. If the electron detector 16 is an avalanche photodiode, output of the electron detector 6 is increased.

The first conductive film 27 and the second conductive film 29 cover a surface 14*c* of the projection portion 14, and can function as wiring to the electron detector 6. Either one of the first conductive film 27 and the second conductive film 29 may be replaced with a metal wire.

The first conductive film 27 preferably has an electrode pad portion 27*a* formed on a top face 14*b* of the projection potion 14. The electrode pad portion 27*a* is preferably electrically connected to the p-type region 16*p* by, for example, a gold wire 46 or the like.

The second conductive film 29 preferably has an electrode pad portion 29*a* formed on the top face 14*b* of the projection potion 14. The size of the electrode pad portion 29*a* is, for example, larger than the size of the electrode pad portion 27*a*. The electrode pad portion 29*a* is electrically connected to the n-type region 16*n* by, for example, a conductive adhesive 19. The shape of the electrode pad portion 29*a* is, for example, a square. The shape of the electrode pad portion 29*a* is preferably almost the same as the shape of the electrode detector 16 for performing alignment with accuracy.

The first conductive film 27 and the second conductive film 29 may have parts 27*p* and 29*p* extending from the root of the projection portion 14 to the opening 17. These parts 27*p* and 29*p* are formed on a face 12*t* at the vacuum side of the stem portion 12*c*.

The second conductive film 29 is arranged in a manner separated from the first conductive film 27. The separation distance D between the first conductive film 27 and the second conductive film 29 is preferably to such a degree as not to generate current leakage or an electric discharge therebetween, and where a potential difference (bias voltage) between the first conductive film 27 and the second conductive film 29 is provided as Vb(V), the separation distance D is preferably Vbμm or more. The bias voltage is preferably +300V to 500V. The separation distance D is preferably 300 μm or more, and more preferably, 500 μm or more.

The first conductive film 27 and the second conductive film 29 preferably substantially cover the whole surface 14*c* (side face 14*a* and top face 14*b*) of the projection portion 14. The surface area S1 of the projection portion 14 to be covered by the first conductive film 27 is preferably larger than the surface area S2 of the projection portion 14 to be covered by the second conductive film 29. Potential of the first conductive film 27 is preferably a ground potential (0V).

The first conductive film 27 preferably includes a Cr film on the surface 14*c* of the projection portion 14, a Ni film on the Cr film, and a Au film on the Ni film. The second conductive film 29 preferably includes a Cr film on the surface 14*c* of the projection portion 14, a Ni film on the Cr film, and a Au film on the Ni film. The film thicknesses of the first conductive film 27 and the second conductive film 29 are preferably approximately 1 μm, respectively. When the gold wire 46 is formed, for satisfactorily connecting the gold wire 46 and the first conductive film 27, the outermost surface is preferably a Au film.

The first conductive film 27 and the second conductive film 29 may include a Ti film on the surface 14*c* of the projection portion 14, a Pt film on the Ti film, and a Au film on the Pt film, may include a Cr film on the surface 14*c* of the projection portion 14 and a Au film on the Cr film, or may include a Cr film on the surface 14*c* of the projection portion 14, a Ni film on the Cr film, and a Cu film on the Ni film.

From the face 12*t* at the vacuum side of the stem portion 12*c* to the side face 14*a* of the projection portion 14, a metal wire 26 may be arranged on the first conductive film 27 and the second conductive film 29. Using the metal wire 26 allows reducing electric resistance and reliably maintaining an electrical connection even at a boundary between the stem portion 12*c* and the projection portion 14. One end of the metal wire 26 is welded to, for example, an electrode pin 38 of the sealing body 30. Further, for ensuring an electrical connection between the metal wire 26 and the first conductive film 27 and the second conductive film 29, a solder 28 may be formed on the metal wire 26. The metal wire 26 is made of, for example, Kovar.

The face plate portion 12*a*, the side tube portion 12*b*, and the stem portion 12*c* may be provided as separate pieces from each other, or adjacent members thereof may be integrated with each other. In the present embodiment, the face plate portion 12*a* and the side tube portion 12*b* are integrated, and the side tube portion 12*b* and the stem portion 12*c* are provided as separate pieces from each other. A first metal film 23 is preferably provided by evaporation on an end face 13*c* of the side tube portion 12*b*. On a marginal part 15 of the face 12*t* at the vacuum side of the stem portion 12*c*, a second metal film 25 arranged facing the first metal film 23 is preferably provided by evaporation. On an outer wall face 13*d* of the side tube portion 12*b* adjacent to the end face 13*c* of the side tube portion 12*b*, a third metal film 23*a* is preferably provided by evaporation. The first metal film 23 may be either integrated with the third metal film 23*a* or provided separately therefrom. The first metal film 23 and the third metal film 23*a* and the second metal film 25 are contacted with a sealing member 22 made of a low-melting-point metal such as, for example, a solder (InSn, In), and a gap between the side tube portion 12*b* and the stem portion 12*c* is sealed by the sealing member 22. Since the sealing member 22 is made of a low-melting-point metal, a sealing region is formed so as to climb up onto the third metal film 23*a* besides between the first metal film 23 and the second metal film 25. Therefore, the gap between the side tube portion 12*b* and the stem portion 12*c* can be reliably sealed by the sealing member 22.

The outer wall face 13*d* of the side tube portion 12*b* is preferably arranged at a more inner side (closer to the tube axis Ax of the electron tube 10) than a side face 15*a* of the stem portion 12*c*. In this case, the sealing member 22 to climb up onto the third metal film 23*a* can be increased in portion. Accordingly, the gap between the side tube portion 12*b* and the stem portion 12*c* can be more reliably sealed. In the marginal part 15 of the face 12*t* at the vacuum side of the stem portion 12*c*, it is preferable that the distance between an imaginary plane including the end face 13*c* of the side tube portion 12*b* and the marginal part 15 becomes larger as it goes to the outside (direction to separate from the tube axis Ax of the electron tube 10). In this case, since a larger portion of sealing member 22 can be held between the end face 13*c* and the marginal part 15, the gap between the side tube portion 12*b* and the stem portion 12*c* can be more reliably sealed. Moreover, the sealing member 22 can be suppressed from sticking out into the vacuum vessel 12. For example, it is preferable that the marginal part 15 of the face 12*t* at the vacuum side of the stem portion 12*c* slants so that the thickness of the stem portion 12*c* is gradually reduced as it goes to the outside.

A chamfered portion 13*p* may be formed at the outer wall face 13*d* side in the end face 13*c* of the side tube portion 12*b*. If the chamfered portion 13*p* is formed, a larger portion of sealing member 22 can be held between the end face 13*c* and the marginal part 15, and thus the gap between the side tube portion 12*b* and the stem portion 12*c* can be more reliably sealed. A chamfered portion 13*q* may be formed at the inner wall face 13*e* side in the end face 13*c* of the side tube portion 12*b*. If the chamfered portion 13*q* is formed, a larger portion of sealing member 22 can be held between the end face 13*c* and the marginal part 15 in conjunction with the metal film on the chamfered portion 13*q*, and thus the sealing member 22 can be further suppressed from sticking out into the vacuum vessel 12.

The first metal film 23 preferably includes a Cr film on the end face 13*c* of the side tube portion 12*b*, a Ni film on the Cr film, and a Au film on the Ni film. In this case, the gap between the side tube portion 12*b* and the stem portion 12*c* can be more reliably sealed. The first metal film 23 may include a Ti film on the end face 13*c*, a Pt film on the Ti film, and a Au film on the Pt film, may include a Cr film on the end face 13*c*, a Ni film on the Cr film, and a Cu film on the Ni film, or may include a Cr film on the end face 13*c* and a Au film on the Cr film.

The second metal film 25 preferably includes a Cr film on the marginal part 15 of the face 12*t* at the vacuum side of the stem portion 12*c*, a Ni film on the Cr film, and a Au film on the Ni film. In this case, the gap between the side tube portion 12*b* and the stem portion 12*c* can be more reliably sealed. The second metal film 25 may include a Ti film on the marginal part 15, a Pt film on the Ti film, and a Au film on the Pt film, or may include a Cr film on the marginal part 15, a Ni film on the Cr film, and a Cu film on the Ni film.

The third metal film 23*a* preferably includes a Cr film on the outer wall face 13*d* of the side tube portion 12*b*, a Ni film on the Cr film, and a Au film on the Ni film. In this case, the gap between the side tube portion 12*b* and the stem portion 12*c* can be more reliably sealed. The third metal film 23*a* may include a Ti film on the outer wall face 13*d*, a Pt film on the Ti film, and a Au film on the Pt film, may include a Cr film on the outer wall face 13*d*, a Ni film on the Cr film, and a Cu film on the Ni film, or may include a Cr film on the end face 13*c* and a Au film on the Cr film.

In the electron tube 10 of the present embodiment, since the sealing member 22 serving as a metal member is made of a low-melting-point metal, the sealing member 22 is formed so as to climb up onto the third metal film 23*a* besides between the first metal film 23 and the second metal film 25, thereby becoming a sealing region. Therefore, the gap between the side tube portion 12*b* and the stem portion 12*c* can be reliably sealed by the sealing member 22.

It is preferable to use the first conductive film 27 and the second conductive film 29 as the wiring to be connected to the electron detector 16. In this case, the wiring can be reliably connected to the electron detector 16 and the wiring can be stably installed. Since the first conductive film 27 and the second conductive film 29 cover the surface 14*c* of the projection portion 14, even when photoelectrons from the photocathode 18 or reflected or scattered electrons thereof are made incident into the projection portion 14, charging thereof can be suppressed. As a result, the electric field around the projection portion 14 can be stabilized.

The first conductive film 27 and the second conductive film 29 preferably substantially cover the whole surface 14*c* of the projection portion 14. In this case, since charging of the projection portion 14 can be further suppressed, the electric field around the projection portion 14 can be further stabilized.

It is preferable that the surface area S1 of the projection portion 14 to be covered by the first conductive film 27 is larger than the surface area S2 of the projection portion 14 to be covered by the second conductive film 29, and potential of the first conductive film 27 is a ground potential. In this case, since most of the whole surface 14*c* of the projection portion 14 comes to have a ground potential having less voltage fluctuation, the electric field around the projection portion 14 can be further stabilized.

It is preferable that the first conductive film 27 and the second conductive film 29 each include a Cr film on the surface 14*c* of the projection portion 14, a Ni film on the Cr film, and a Au film on the Ni film. In this case, the thickness of the first conductive film 27 and the second conductive film 29 can be increased. Accordingly, electric resistance of the first conductive film 27 and the second conductive film 29 can be reduced.

In the electron tube 10, a vacuum can be maintained by the lid portion 34 sealing the opening 17 via the joining member 32. Also, since the coefficient of thermal expansion of synthetic silica is different from that of Kovar, if the lid portion 34 has a flat plate shape, the surface area of a part corresponding to the opening 17 in the lid portion 34 becomes almost equal to a cross-sectional area of the opening 17, and thus there is a possibility that the lid portion 34 is damaged due to stress at cooling so that a vacuum can no longer be maintained. However, in the electron tube 10, since the lid portion 34 has the recess portion 34*a*, the surface area of a part corresponding to the opening 17 in the lid portion 34 becomes larger than a cross-sectional area of the opening 17, and therefore, a vacuum can be maintained by absorbing the stress in the recess portion 34*a*. Moreover, since the recess portion 34*a* is depressed to the vacuum side, an unreasonable force is not easily applied to the lid portion 34 even due to a difference between the internal and external pressures of the vacuum vessel 12. Further, since the lid portion 34 is electrically connected to the electron detector 16 via the first conductive film 27 and the second conductive film 29, a potential can be imparted to the electron detector 16 by imparting the potential to the lid portion 34.

It is preferable that the lid portion 34 has the marginal portion 34*b* surrounding the recess portion 34*a*, and the marginal portion 34*b* is connected to the stem portion 12*c* via the joining member 32. In this case, since the stress can be absorbed in the whole recess portion 34*a*, a vacuum can be more reliably maintained.

When the lid portion 34 is arranged outside the vacuum vessel 12 and separated from the inner surface 17*p* of the opening 17, as compared to when the lid portion 34 is in contact with the inner surface 17*p* of the opening 17, the creepage distance between the lid portion 34 and its adjacent potential applying member (for example, the neighboring first electrode pin 38) is long. As a result, generation of current leakage can be suppressed.

The bottom surface of the recess portion 34*a* is preferably flat. In this case, it is easy to join the first tubular member 36 and the second tubular member 40 to the bottom surface of the recess portion 34*a*.

The electron tube 10 preferably includes the first tubular member 36, the second tubular member 40, the first electrode pin 38, and the second electrode pin 42. The first tubular member 36 and the second tubular member 40 allow reliably fixing the first electrode pin 38 and the second electrode pin 42 to the lid portion 34, respectively. Moreover, since the first electrode pin 38 and the second electrode pin 42 need not penetrate through the lid portion 34, a vacuum can be more reliably maintained.

The first tubular member 36 and the second tubular member 40 preferably have the flange portion 36*a* and the flange portion 40*a* to be electrically connected to the lid portion 34 at ends of the first tubular member 36 and the second tubular member 40, respectively. In this case, the flange portion 36*a* and the flange portion 40*a* allow reliably fixing the first tubular member 36 and the second tubular member 40 to the lid portion 34, respectively The electron tube 10 can be used as a radiation detector in combination with a scintillator that emits light upon incidence of radiation. In that case, since the quantity of radiation to be generated from the electron tube 10 is reduced, noise at the time of radiation detection is reduced. In particular, since the electron tube 10 has a structure without a dynode being an electron-multiplier section made of a metal, the quantity of radiation to be generated from the electron tube 10 is further reduced by using the electron tube 10. Therefore, usage of the electron tube 10 is particularly effective for detecting a minute quantity of radiation. It is preferable to arrange a plurality of electron tubes 10 so as to surround the scintillator. For the scintillator, Xe may be used, or Ar may be used.

The electron tube 10 is manufactured in the following manner. First, the openings 17 and 17*a* are formed in a flat plate-shaped stem portion to obtain the stem portion 12*c*. In addition, the recess portion 34*a* is formed in a flat plate-shaped lid portion to obtain the lid portion 34. Further, the first electrode pin 38 and the second electrode pin 42 are inserted in the first tubular member 36 and the second tubular member 40 and welded thereto, respectively, and the first tubular member 36 and the second tubular member 40 are welded to both surfaces of the lid portion 34, respectively. Then, the joining member 32 is interposed between the stem portion 12*c* and the lid portion 34, and the openings 17 and 17*a* are sealed by heating and pressurization. In this manner, the sealing bodies 30 and 30*a* attached to the stem portion 12*c* are obtained.

Further, the first conductive film 27 and the second conductive film 29 are evaporated on the projection portion 14 and the stem portion 12*c*. The first metal film 23 is evaporated on the end face 13*c* of the side tube portion 12*b*, and the third metal film 23*a* is evaporated on the outer wall face 13*d* of the side tube portion 12*b*. The second metal film 25 is evaporated on the marginal part 15 of the face 12*t* at the vacuum side of the stem portion 12*c*. Then, the electron detector 16 is installed on the electrode pad portion 29*a* via the conductive adhesive 19. Then, the gold wire 46 is bonded. Further, the metal wire 26 is welded to the electrode pin 38, and the metal wire 26 and the first conductive film 27 and the second conductive film 29 are adhered by the solder 28.

Subsequently, in a vacuum, a low-melting-point metal is placed on the second metal film 25 and heated to the melting point of the low-melting-point metal or more, for example, 200° C. Then, the molten low-melting-point metal is shaped. Further, the photocathode 18 is formed on the face plate portion 12*a*. The stem portion 12*c* and the side tube portion 12*b* are set on a sealing unit. By pushing up its table on which the stem portion 12*c* has been set, the stem portion 12*c* and the side tube portion 12*b* are joined in a vacuum. The sealing member 22 made of a low-melting-point metal is thereby formed. The sealing temperature is preferably, for example, 200° C. In this case, influence on the photocathode 18 is small.

Second Embodiment

Figure 6:
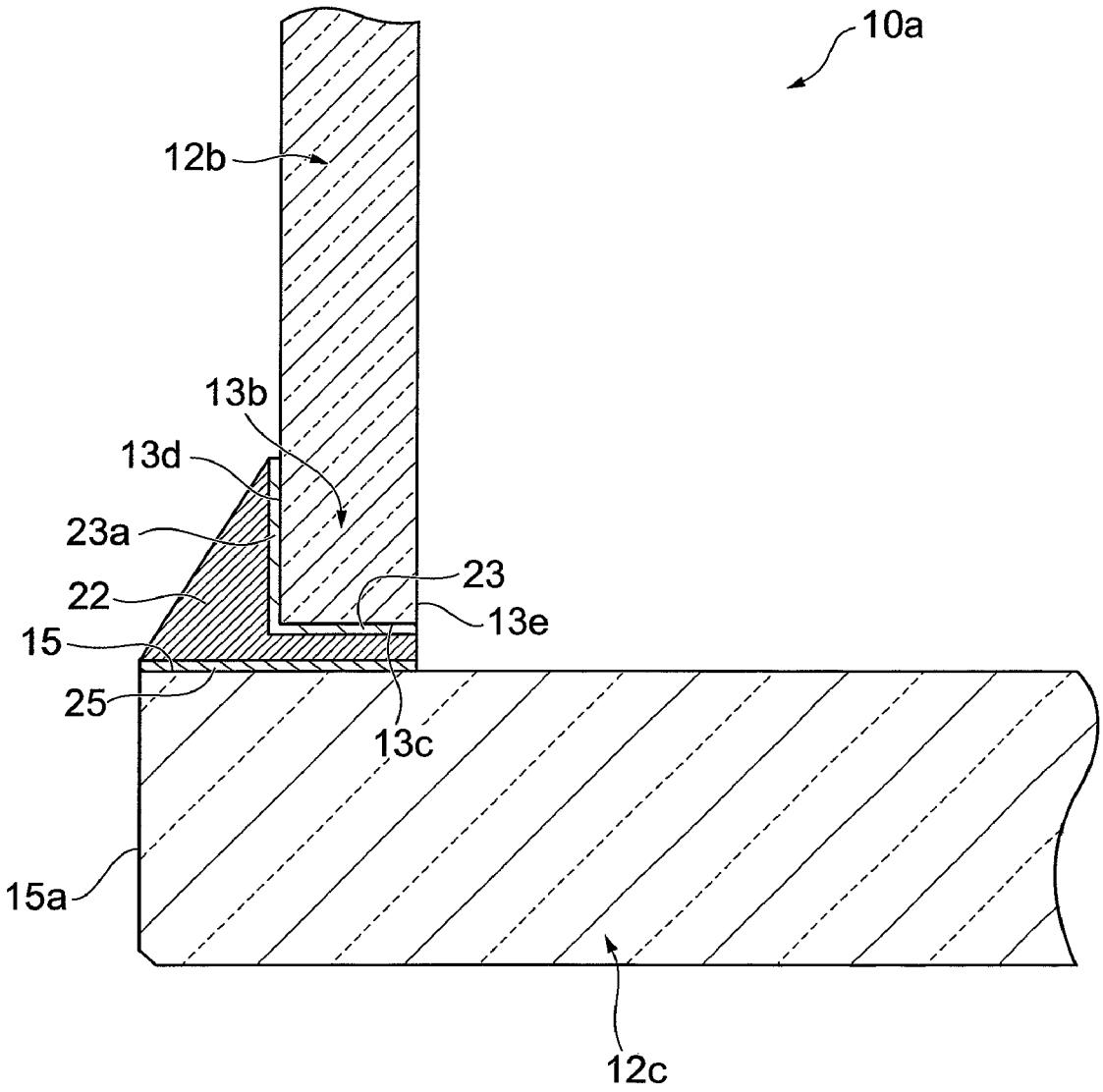
FIG. 6 is a longitudinal sectional view showing a part of an electron tube according to a second embodiment.

FIG. 6 is a longitudinal sectional view showing a part of an electron tube according to a second embodiment. For the electron tube 10*a* shown in FIG. 6, in the electron tube 10 shown in FIG. 1 to FIG. 5, the chamfered portion 13*p* and the chamfered portion 13*q* are not formed, and the marginal part 15 of the face 12*t* at the vacuum side of the stem portion 12*c* does not slant. The thickness of the stem portion 12*c* in the marginal part 15 is almost fixed. In this case as well, since the sealing member 22 is made of a low-melting-point metal, the sealing member 22 is formed so as to climb up onto the third metal film 23*a* besides between the first metal film 23 and the second metal film 25, thereby becoming a sealing region. Therefore, the gap between the side tube portion 12*b* and the stem portion 12*c* can be reliably sealed by the sealing member 22.

Third Embodiment

Figure 7:
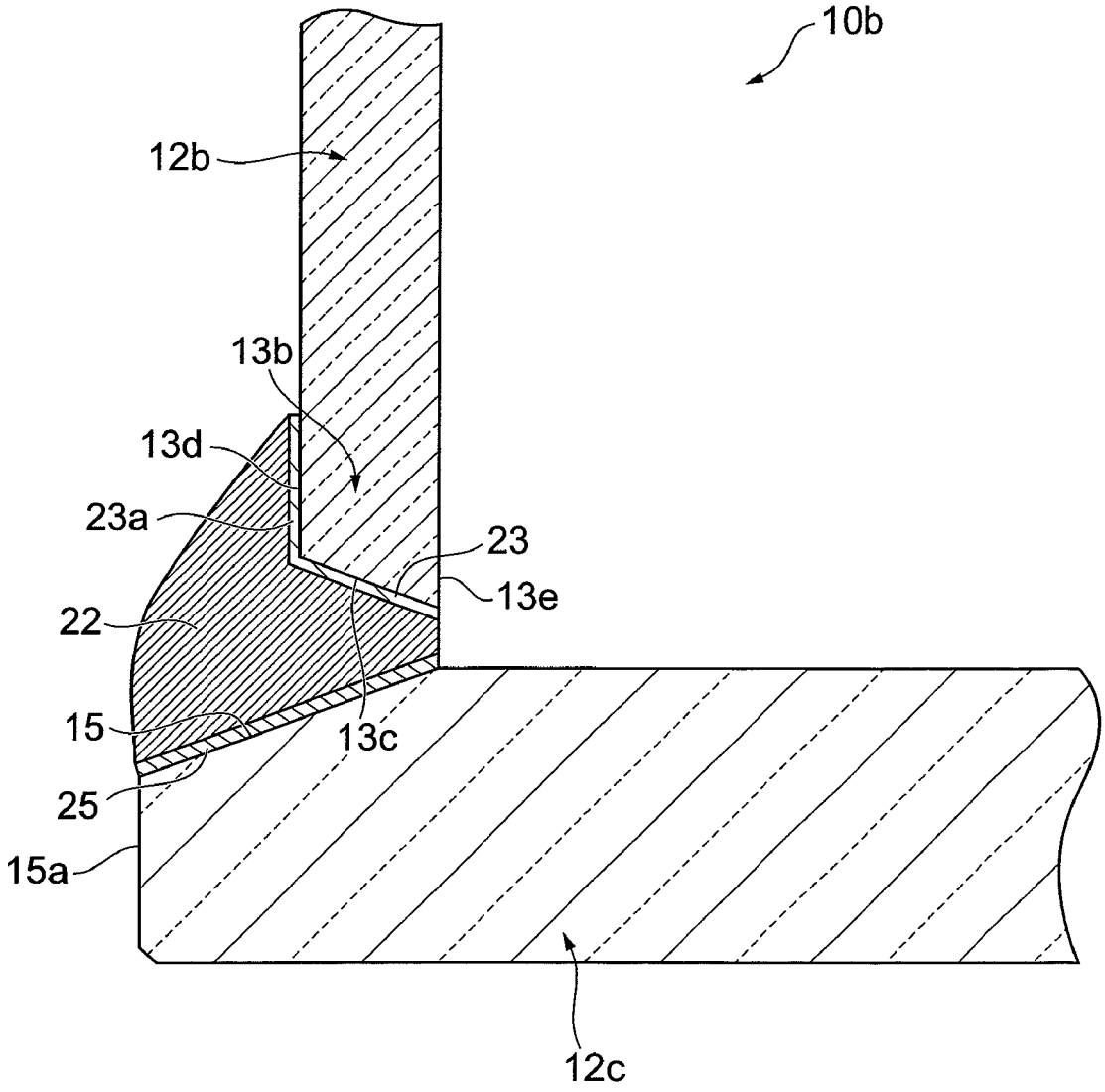
FIG. 7 is a longitudinal sectional view showing a part of an electron tube according to a third embodiment.

FIG. 7 is a longitudinal sectional view showing a part of an electron tube according to a third embodiment. For the electron tube 10*b* shown in FIG. 7, in the electron tube 10 shown in FIG. 1 to FIG. 5, the chamfered portion 13*p* and the chamfered portion 13*q* are not formed, and the end face 13*c* slants toward the inside so as to form an acute angle with the inner wall face 13*e*. Therefore, the distance between an imaginary plane including the end face 13*c* of the side tube portion 12*b* and the marginal part 15 becomes still larger as it goes to the outside than in the electron tube 10. Accordingly, a larger portion of sealing member 22 can be arranged between the end face 13*c* and the marginal part 15, and thus the gap between the side tube portion 12*b* and the stem portion 12*c* can be more reliably sealed.

Fourth Embodiment

Figure 8:
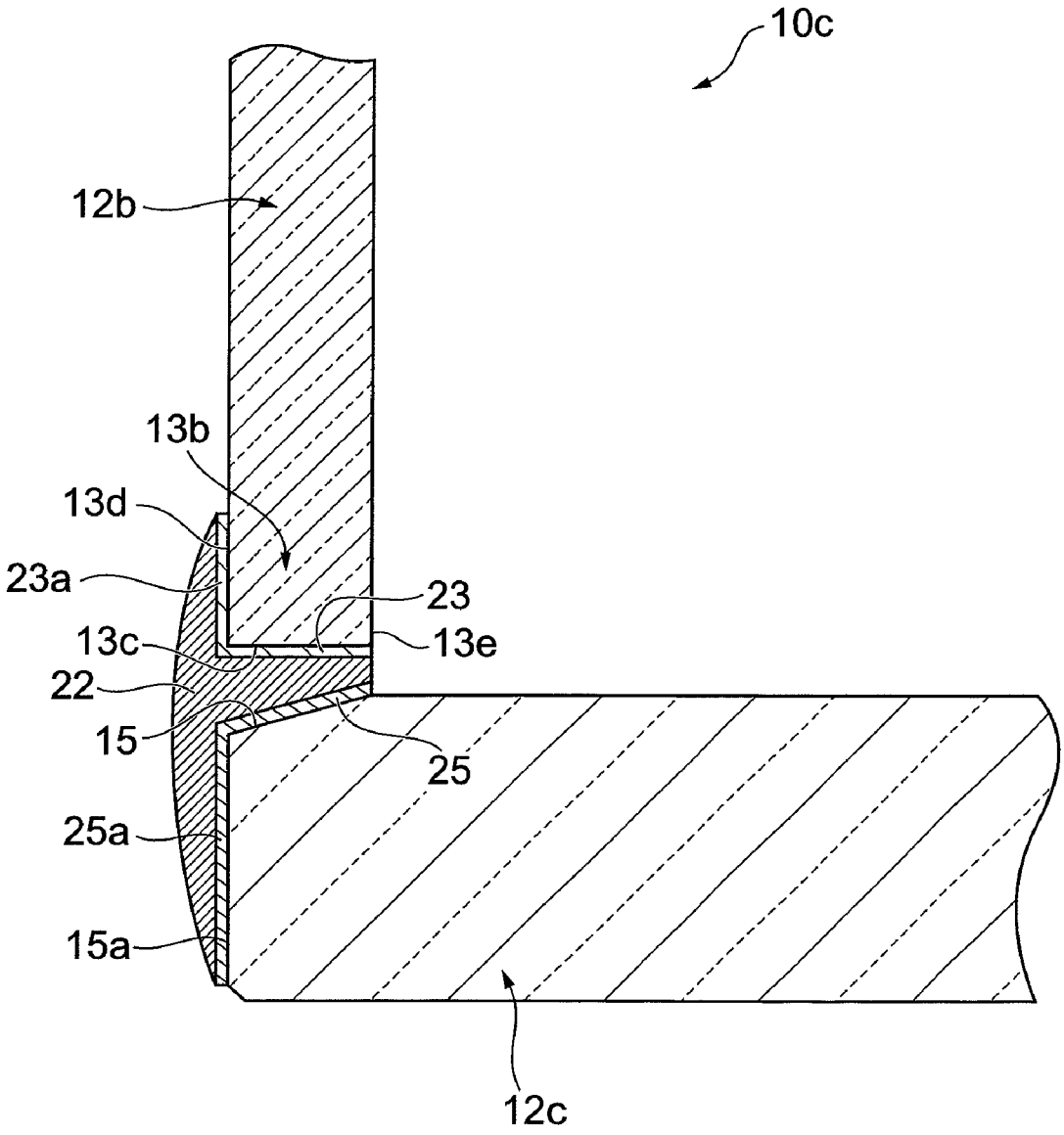
FIG. 8 is a longitudinal sectional view showing a part of an electron tube according to a fourth embodiment.

FIG. 8 is a longitudinal sectional view showing a part of an electron tube according to a fourth embodiment. For the electron tube 10*c* shown in FIG. 8, in the electron tube 10 shown in FIG. 1 to FIG. 5, the chamfered portion 13*p* and the chamfered portion 13*q* are not formed, the outer wall face 13*d* of the side tube portion 12*b* is arranged on an identical plane to the side face 15*a* of the stem portion 12*c*, and a fourth metal film 25*a* is formed on the side face 15*a* of the stem portion 12*c*. In this case, since the sealing member 22 is made of a low-melting-point metal, the sealing member 22 is formed so as to climb up onto the third metal film 23*a* and the fourth metal film 25*a* besides between the first metal film 23 and the second metal film 25, thereby becoming a sealing region. Therefore, the gap between the side tube portion 12*b* and the stem portion 12*c* can be reliably sealed by the sealing member 22.

Fifth Embodiment

Figure 9:
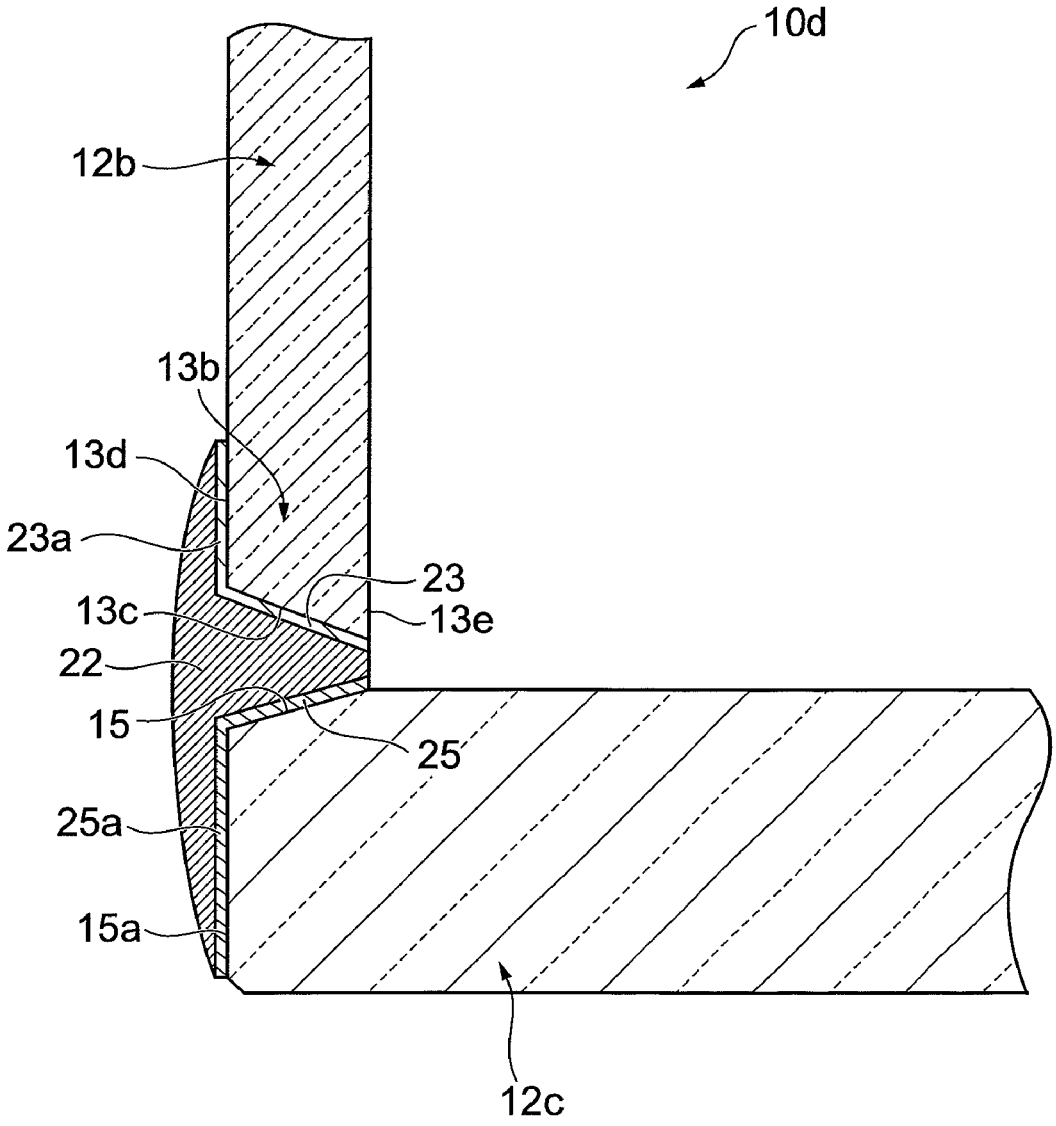
FIG. 9 is a longitudinal sectional view showing a part of an electron tube according to a fifth embodiment.

FIG. 9 is a longitudinal sectional view showing a part of an electron tube according to a fifth embodiment. For the electron tube 10*d* shown in FIG. 9, in the electron tube 10*c* shown in FIG. 8, the end face 13*c* slants toward the inside so as to form an acute angle with the inner wall face 13*e*. Therefore, the distance between an imaginary plane including the end face 13*c* of the side tube portion 12*b* and the marginal part 15 becomes still larger as it goes to the outside than in the electron tube 10*c*. Accordingly, a larger portion of sealing member 22 can be arranged between the end face 13*c* and the marginal part 15, and thus the gap between the side tube portion 12*b* and the stem portion 12*c* can be more reliably sealed.

Sixth Embodiment

Figure 10:
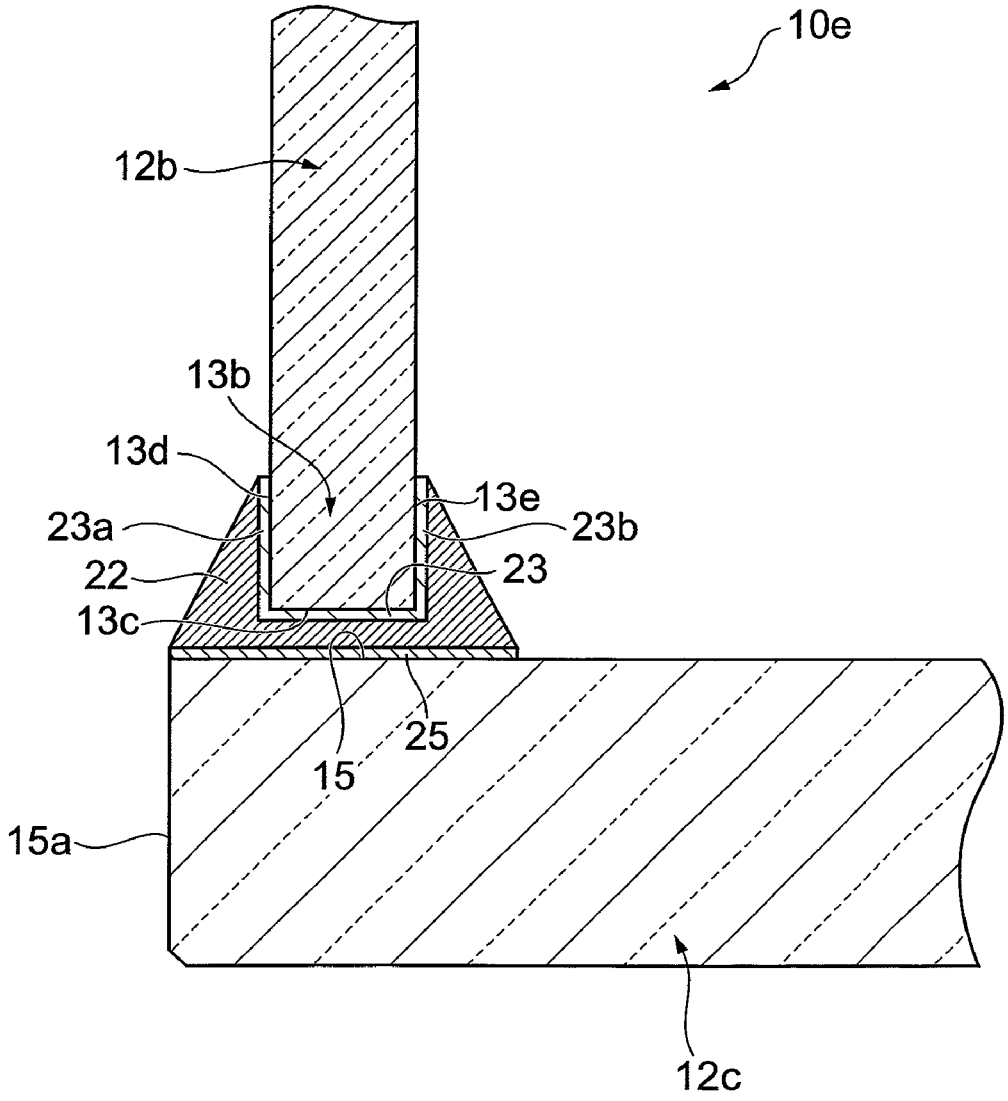
FIG. 10 is a longitudinal sectional view showing a part of an electron tube according to a sixth embodiment.

FIG. 10 is a longitudinal sectional view showing a part of an electron tube according to a sixth embodiment. For the electron tube 10*e* shown in FIG. 10, in the electron tube 10*a* shown in FIG. 6, a fifth metal film 23*b* is formed on the inner wall face 13*e* of the side tube portion 12*b*. In this case, since the sealing member 22 is made of a low-melting-point metal, the sealing member 22 is formed so as to climb up onto the third metal film 23*a* and the fifth metal film 23*b* besides between the first metal film 23 and the second metal film 25, thereby becoming a sealing region. Therefore, the gap between the side tube portion 12*b* and the stem portion 12*c* can be reliably sealed by the sealing member 22. Moreover, the second metal film 25 is also formed at the inner side than a plane including the inner wall face 13*e* of the side tube portion 12*b*. Therefore, a larger portion of sealing member 22 can be formed on the fifth metal film 23*b*.

Seventh Embodiment

Figure 11:
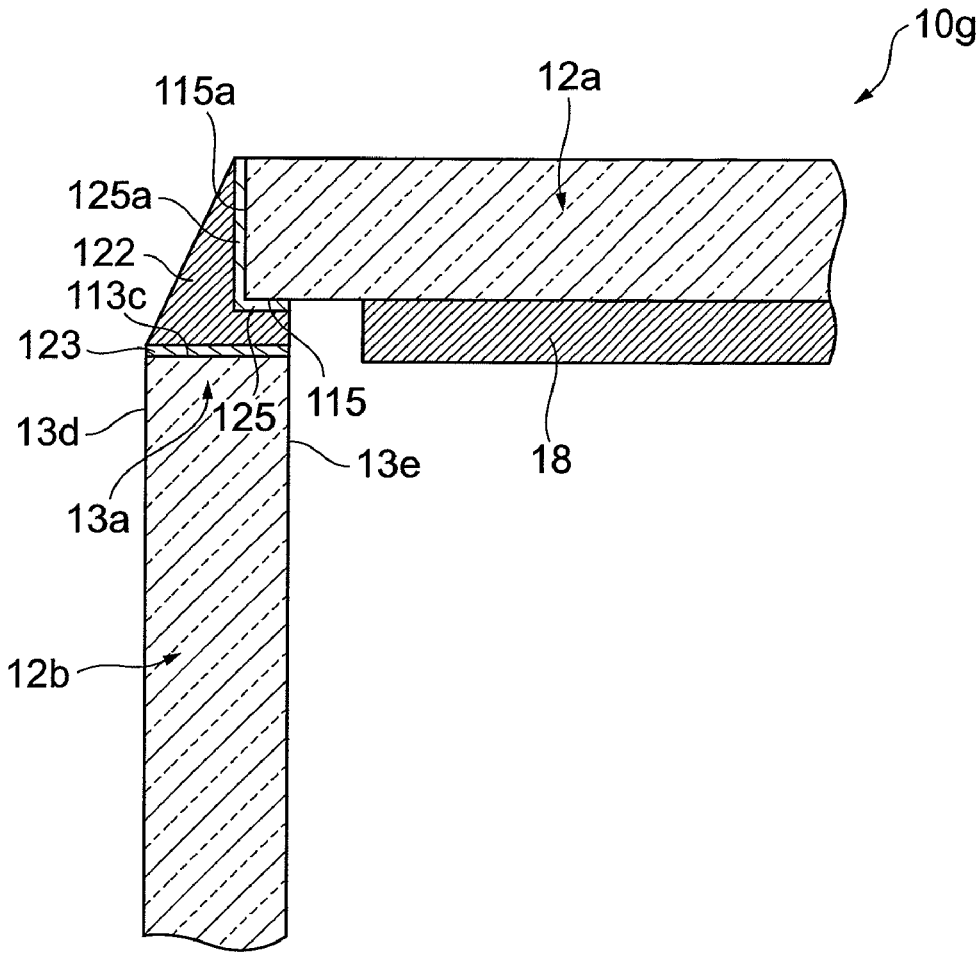
FIG. 11 is a longitudinal sectional view showing a part of an electron tube according to a seventh embodiment.

FIG. 11 is a longitudinal sectional view showing a part of an electron tube according to a seventh embodiment. For the electron tube 10*g* shown in FIG. 11, in the electron tube 10 shown in FIG. 1 to FIG. 5, while the face plate portion 12*a* is provided as a flat plate, the face plate portion 12*a* and the side tube portion 12*b* are provided as separate pieces from each other. The side tube portion 12*b* and the stem portion 12*c* may be either integrated or provided as separate pieces from each other.

On an end face 113*c* (end face at the side opposite to the end face 13*c*) of the side tube portion 12*b*, a first metal film 123 is provided. On a marginal part 115 of the face 12*p* at the vacuum side of the face plate portion 12*a*, a second metal film 125 is provided. On a side face 115*a* of the face plate portion 12*a* adjacent to the marginal part 115, a third metal film 125*a* is provided. The first metal film 123, the second metal film 125, and the third metal film 125*a* are contacted with a sealing member 122 serving as a metal member made of a low-melting-point metal. Since the sealing member 122 is made of a low-melting-point metal, the sealing member 122 is formed so as to climb up onto the third metal film 125*a* besides between the first metal film 123 and the second metal film 125, thereby becoming a sealing region. Therefore, the gap between the side tube portion 12*b* and the face plate portion 12*a* can be reliably sealed by the sealing member 122.

The outer wall face 13*d* of the side tube portion 12*b* is arranged at a more outer side than the side face 115*a* of the face plate portion 12*a*. In this case, a larger portion of sealing member 122 can be formed on the third metal film 125*a*.

Eighth Embodiment

Figure 12:
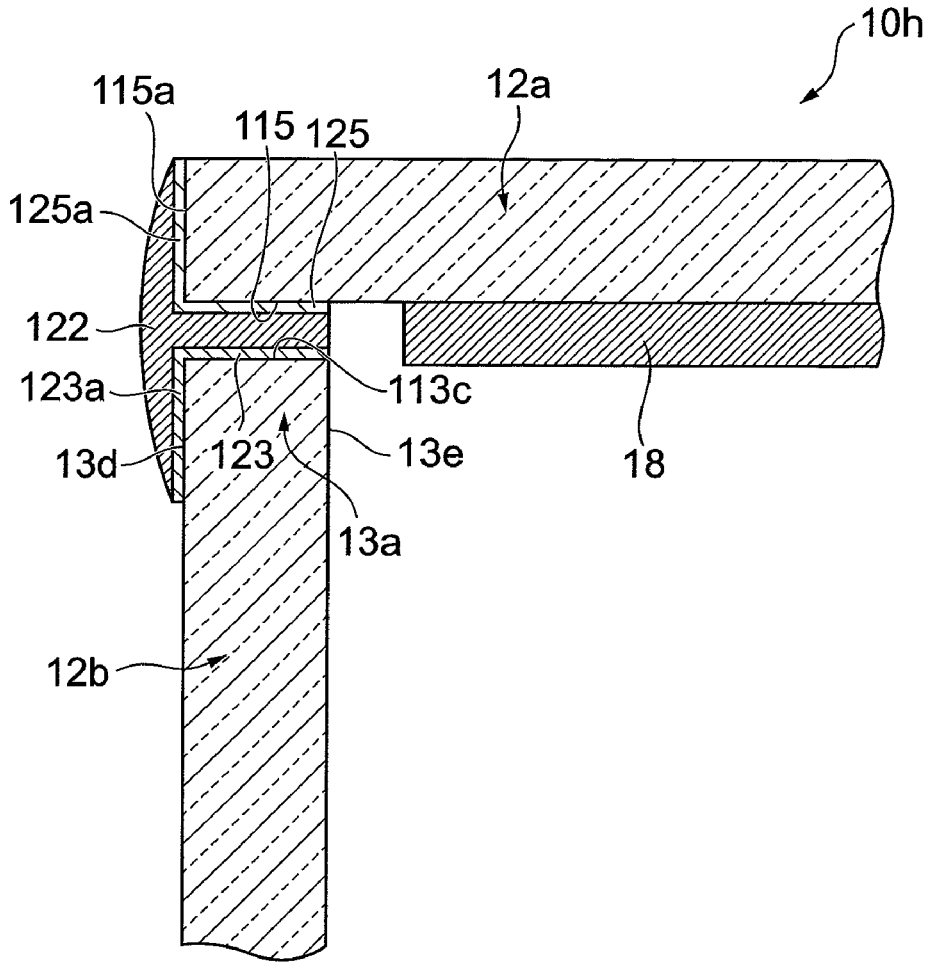
FIG. 12 is a longitudinal sectional view showing a part of an electron tube according to an eighth embodiment.

FIG. 12 is a longitudinal sectional view showing a part of an electron tube according to an eighth embodiment. For the electron tube 10*h* shown in FIG. 12, in the electron tube 10*g* shown in FIG. 11, the outer wall face 13*d* of the side tube portion 12*b* is arranged on an identical plane to the side face 115*a* of the face plate portion 12*a*, and a fourth metal film 123*a* is formed on the outer wall face 13*d* of the side tube portion 12*b*. In this case, since the sealing member 122 is made of a low-melting-point metal, the sealing member 122 is formed so as to climb up onto the third metal film 125*a* and the fourth metal film 123*a* besides between the first metal film 123 and the second metal film 125, thereby becoming a sealing region. Therefore, the gap between the side tube portion 12*b* and the face plate portion 12*a* can be reliably sealed by the sealing member 122.

Although preferred embodiments of the present invention have been described in detail in the above, the present invention is by no means limited to the above embodiments, or by no means limited to constructions that provide the above various effects. For example, the joining structure of the side tube portion 12*b* and the stem portion 12*c* in the electron tube 10, 10*a*, 10*b*, 10*c*, 10*d*, 10*e* may be applied to a joining structure of the side tube portion 12*b* and the face plate portion 12*a*. The joining structure of the side tube portion 12*b* and the face plate portion 12*a* in the electron tube 10*g*, 10*h* may be applied to a joining structure of the side tube portion 12*b* and the stem portion 12*c*. In the electron tube 10, 10*a*, 10*b*, 10*c*, 10*d*, 10*e*, the outer wall face 13*d* of the side tube portion 12*b* may be arranged at a more outer side than the side face 15*a* of the stem portion 12*c*. In this case, it is preferable to form a third metal film on the side face 15*a* of the stem portion 12*c* to be at the inner side. Moreover, it is preferable to form the sealing member 22 while arranging the stem portion 12*c* above the side tube portion 12*b*. At least one of the face plate portion 12*a*, the stem portion 12*c*, the side tube portion 12*b*, and the projection portion 14 may be made of quartz such as fused silica not synthetic silica, or glass other than those. In place of the electron detector 16, an electron-multiplier section formed of a dynode and an anode by which amplified electrons are collected may be provided as an electron detecting section. In this case, the electron-multiplier section and anode and the sealing body 30 are electrically connected to function as an ordinary photomultiplier tube. When attaching importance to extracting a signal from the electron detector 16 with more suppressed noise, the potentials to be applied to the first conductive film 27 and the second conductive film 29 may be opposite. While the whole side face of the projection portion 14 may be covered only with the first conductive film 27, wiring may be separately provided to the n-type region 16*n*, and vice versa.

Here, the generation quantity of radiation was measured in terms of a Kovar glass (borosilicate glass), Kovar (Fe—Ni—Co alloy), and synthetic silica in order to confirm that the generation quantity of radiation is small in synthetic silica. In the measurement, Coming 7056 was used as a sample of the Kovar glass, and KV-2, as a sample of Kovar, and an ES grade, as a sample of synthetic silica. Concretely, a germanium radiation detector manufactured by EG&G Inc. was used to measure the energy and count of gamma rays emitted by radioactive impurities contained in the samples. The measured radioactive impurities were 40K (a radioisotope of potassium), a uranium series (a decay series from uranium-238 to lead-206), and a thorium series (a decay series from thorium-232 to lead-208).

Measurement results are shown in Table 1. The figures in the table are in units of Bq/kg.

TABLE 1

| | 40K | Uranium series | Thorium series |
|---|---|---|---|
| Kovar glass | 1500 | 10 | 1 |
| Kovar | 0.1 | 0.2 | 0.1 |
| Synthetic silica | 0 | 0.002 | 0 |

What is claimed is:

1. An electron tube comprising:

a vacuum vessel including a side tube portion made of glass and a plate-like member blocking one opening of the side tube portion and made of glass;

a first metal film provided on an end face of the side tube portion;

a second metal film arranged facing the first metal film and provided on a marginal part of a face at a vacuum side of the plate-like member;

a third metal film provided on at least one of an outer wall face of the side tube portion adjacent to the end face and a side face of the plate-like member adjacent to the marginal part; and a metal member made of a low-melting-point metal, for sealing a gap between the side tube portion and the plate-like member while contacting the first metal film, the second metal film, and the third metal film, wherein the metal member climbs up onto the third metal film and between the first metal film and the second metal film.

2. The electron tube according to claim 1, wherein the outer wall face of the side tube portion is arranged at a more outer side or inner side than the side face of the plate-like member, and the third metal film is provided on a face located at an inner side of one of the outer wall face of the side tube portion and the side face of the plate-like member.

3. The electron tube according to claim 1, wherein in the marginal part, a distance between an imaginary plane including the end face and the marginal part becomes larger as the marginal part goes to the outside.

4. The electron tube according to claim 1, wherein at least one of the first metal film, the second metal film, and the third metal film include a Cr film, a Ni film on the Cr film, and a Au film on the Ni film.

5. The electron tube according to claim 1, wherein the side tube portion and the plate-like member are made of synthetic silica.

6. The electron tube according to claim 1, wherein at least one of the first metal film, the second metal film, and the third metal film includes a Cr film, an Ni film on the Cr film, and a Cu film on the Ni film.

* * * * *